US008136305B2

(12) United States Patent
Mulherin

(10) Patent No.: US 8,136,305 B2
(45) Date of Patent: Mar. 20, 2012

(54) ADJUSTABLE COUNTERTOP MOUNTING SYSTEM

(76) Inventor: Timothy Mulherin, Troy, MO (US)

( * ) Notice: Subject to any disclaimer, the term of this patent is extended or adjusted under 35 U.S.C. 154(b) by 194 days.

(21) Appl. No.: 12/584,978

(22) Filed: Sep. 15, 2009

(65) Prior Publication Data

US 2011/0061312 A1 Mar. 17, 2011

(51) Int. Cl.
*E04H 6/06* (2006.01)
*E04H 1/00* (2006.01)
*E04B 2/74* (2006.01)

(52) U.S. Cl. ..... 52/32; 52/34; 52/35; 52/36.1; 52/36.2; 52/36.4

(58) Field of Classification Search ..... 52/32, 27, 52/29, 34, 35, 36.1, 36.2, 36.4, 36.5, 408, 52/384; 403/295, 397, 403
See application file for complete search history.

(56) References Cited

U.S. PATENT DOCUMENTS

| | | | | |
|---|---|---|---|---|
| 2,716,757 | A * | 9/1955 | Eriksson | 4/645 |
| 4,143,429 | A | 3/1979 | Seymour et al. | |
| 4,158,898 | A * | 6/1979 | Denhart | 4/646 |
| 5,050,253 | A * | 9/1991 | Wasek | 4/645 |
| 5,230,109 | A * | 7/1993 | Zaccai et al. | 4/645 |
| 5,592,886 | A | 1/1997 | Williams et al. | |
| 5,724,773 | A * | 3/1998 | Hall | 52/34 |
| 5,743,501 | A | 4/1998 | Rapp | |
| 5,806,417 | A | 9/1998 | Whiten et al. | |
| 5,867,847 | A * | 2/1999 | Klawitter et al. | 4/645 |
| 6,206,530 | B1 | 3/2001 | Eberts | |
| 6,212,707 | B1 | 4/2001 | Thompson et al. | |
| 6,360,381 | B1 | 3/2002 | Fitzgerald, Sr. | |
| 6,442,905 | B1 | 9/2002 | Weinstein | |
| 6,595,144 | B1 | 7/2003 | Doyle | |
| 6,678,933 | B2 | 1/2004 | Arvin | |
| 6,820,290 | B1 * | 11/2004 | Mullick et al. | 4/663 |
| 7,073,464 | B2 * | 7/2006 | Keil | 119/753 |
| 7,428,882 | B2 * | 9/2008 | Keil | 119/753 |
| 7,472,876 | B2 | 1/2009 | Jones | |
| 7,497,531 | B2 | 3/2009 | Gross | |
| 7,552,511 | B2 | 6/2009 | Campbell et al. | |
| 7,555,815 | B2 | 7/2009 | Tate, Jr. et al. | |
| 7,827,922 | B2 * | 11/2010 | Keil | 108/144.11 |
| 2006/0201448 | A1 * | 9/2006 | Keil | 119/753 |
| 2007/0245977 | A1 * | 10/2007 | Keil | 119/753 |

FOREIGN PATENT DOCUMENTS

EP 0948919 A2 10/1999

OTHER PUBLICATIONS

International Search Report for related PCT application, PCT/US2010/002502, mailed May 27, 2011, in which the examiner states that claims 1-20 are novel, include an inventive step, and have industrial applicability.

* cited by examiner

*Primary Examiner* — Mark Wendell
(74) *Attorney, Agent, or Firm* — Bryan Cave LLP

(57) ABSTRACT

The invention provides an adjustable mounting system for mounting countertops and other similar structures to a wall or other similar structure. Adjustable mounting systems of the invention include hinge adjustment features and/or length adjustment features that allow a single system to be adapted to fit a variety of sizes and/or shapes of spaces. The invention further provides methods of mounting a countertop using an adjustable mounting system.

15 Claims, 15 Drawing Sheets

FIG. 2A
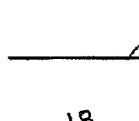
FIG. 2C
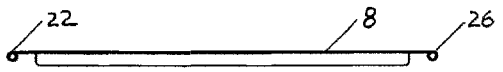
FIG. 2E
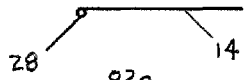
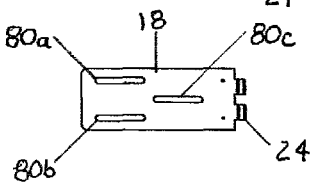
FIG. 2B
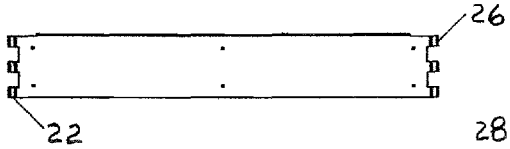
FIG. 2D
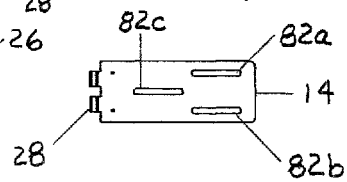
FIG. 2F
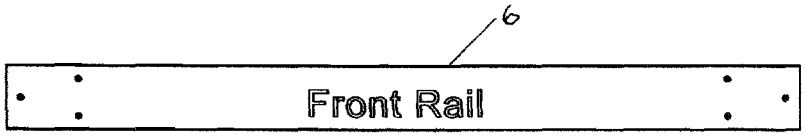
FIG. 2G
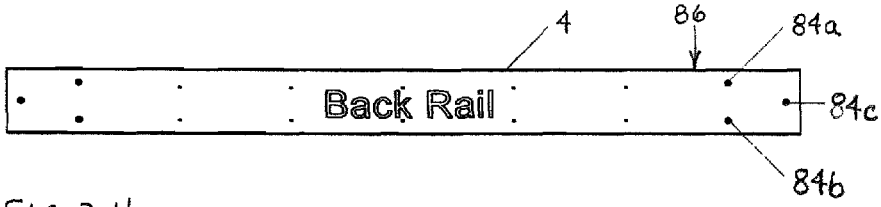
FIG. 2H FIG. 13A
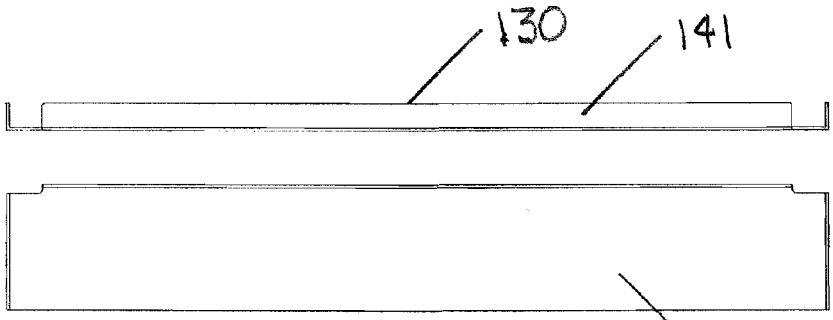
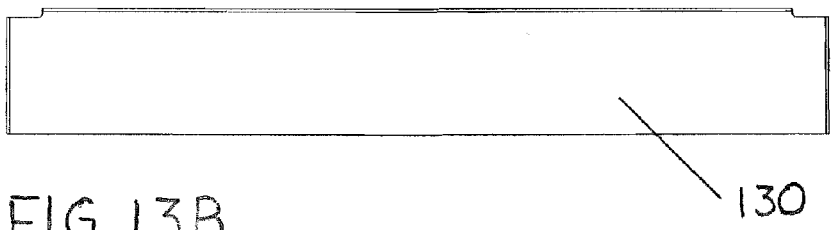
FIG. 13B
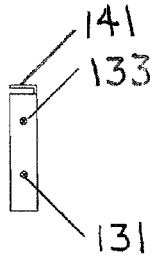
FIG. 13C FIG. 14
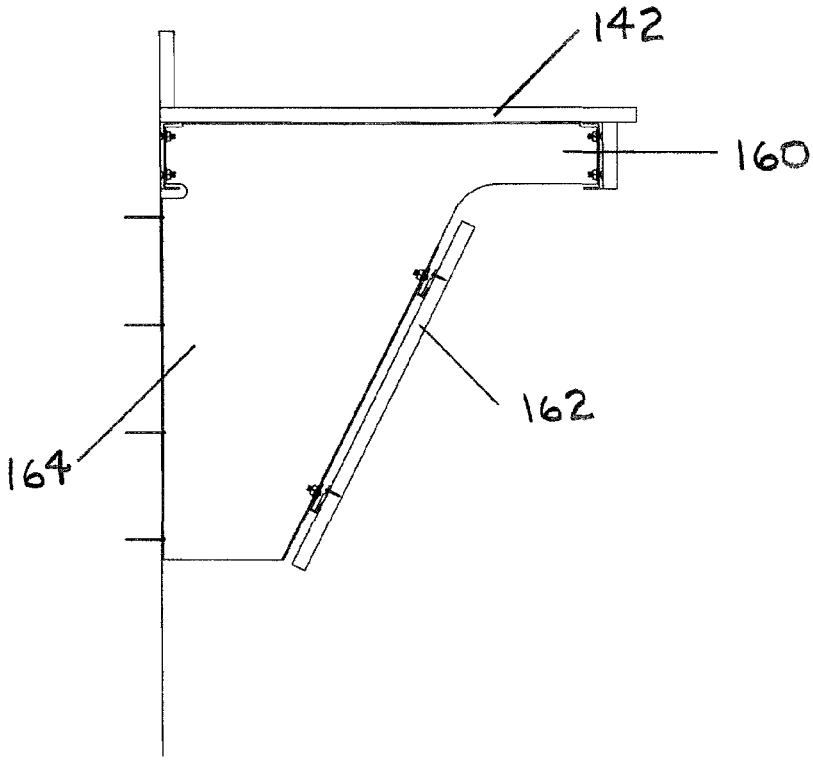
FIG. 15A
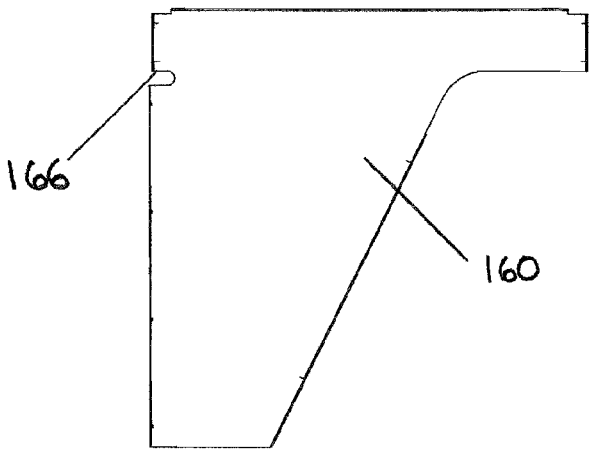
FIG 15B
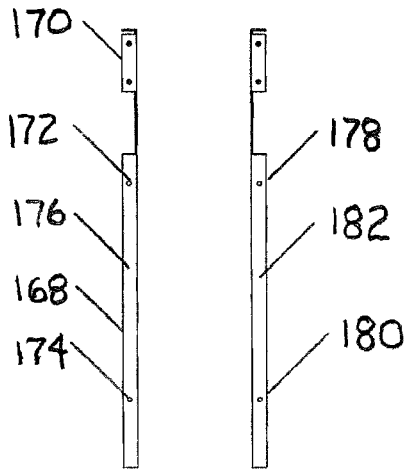
FIG. 15C

ADJUSTABLE COUNTERTOP MOUNTING SYSTEM

FIELD OF THE INVENTION

This invention relates to mounting systems for countertops and other similar and/or related structures.

BACKGROUND OF THE INVENTION

Wall-mount vanities and lavatory units are becoming increasingly popular. A further advantage to wall-mounted systems is that they are, when properly designed, ADA compliant. Particularly popular, especially in the hotel and commercial industry, are wall-mount units in a bathroom area that comprise a horizontal surface, often made of stone or a stone-like product, a sink, and a faucet. Typically, such units also comprise a vertical apron attached to the front of the horizontal surface. A wide variety of materials are and/or may be used for the horizontal surface or "countertop" of such wall-mount units, such as stone, glass, terrazzo, wood, laminate materials, solid surface materials, concrete, metal, and the like.

While wall-mount vanities and similar structures are desirable for both aesthetic and accessibility purposes, current units and, in particular, the mounting structures for such units, suffer from numerous deficiencies, including:

There is little or no uniformity among such mounting structures, which leads to inefficiencies for those using or trying to use such structures;

Mounting structures must be customized for each application—while nominal dimensions per architectural plans may call for identical measurements (e.g., in a series of hotel rooms), in practice, actual dimensions of the mounting area will vary requiring a custom-built mounting structure for each unit.

Accordingly, a need exists for mounting structures and/or systems for mounting countertops, vanities, and other similar and/or related structures that are easy to use and accommodate a variety of sizes and shapes of the mounting area.

BRIEF SUMMARY OF THE INVENTION

An invention having various embodiments that meets one or more of these needs has now been developed.

In one aspect, the invention comprises a countertop mounting system that includes a back member, a side member, and an adjustment member, wherein the adjustment member attaches to the side member to create a hinge adjustment feature and attaches to the back member to create a length adjustment feature. The back member and, optionally, the side member, is adapted to be mounted to a wall.

In another aspect, a system of the invention further comprises a second side member and second adjustment member. A front member and additional adjustment members may also be provided. Support flanges may be provided on one or more of the support members.

In yet another aspect, the invention provides a method of installing a countertop mounting system on a wall comprising: (a) providing a first support member, a first adjustment member, a plurality of fasteners, and a plurality of anchoring devices; (b) attaching the first support member to the first adjustment member with a fastener at a connection point of each of the first support member and the first adjustment member, in which at least one attachment point is an adjustable attachment point; and (c) attaching the first support member to the wall with an anchoring device.

These and other aspects and embodiments of this invention are more fully described below.

BRIEF DESCRIPTION OF THE DRAWINGS

The invention will be better understood from a reading of the following detailed description, taken in conjunction with the accompanying Figures in the drawings in which:

FIG. 2A is a top view of a first adjustment member of a system according to an embodiment of the invention; FIG. 2B is a front view of a first adjustment member of a system according to an embodiment of the invention; FIG. 2C is a top view of a first side member of a system according to an embodiment of the invention; FIG. 2D is a front view of a first side member of a system according to an embodiment of the invention; FIG. 2E is a top view of a second adjustment member of a system according to an embodiment of the invention; FIG. 2F is front view of a second adjustment member of a system according to an embodiment of the invention; FIG. 2G is a front view of a front member of a system according to an embodiment of the invention; and FIG. 2H is a front view of a back member of a system according to an embodiment of the invention;

FIG. 13A is a top view of an intermediate support member of a system according to an embodiment of the invention;

FIG. 13B is a front view of an intermediate support member of a system according to an embodiment of the invention;

FIG. 13A is a side view of an intermediate support member of a system according to an embodiment of the invention;

FIG. 14 is a cross-sectional side view of a portion of an assembled system according to an embodiment of the invention;

FIG. 15A is a side view of a support member of a system according to an embodiment of the invention;

FIGS. 15B and 15C are front views of a support member of a system according to an embodiment of the invention.

Figure 1:
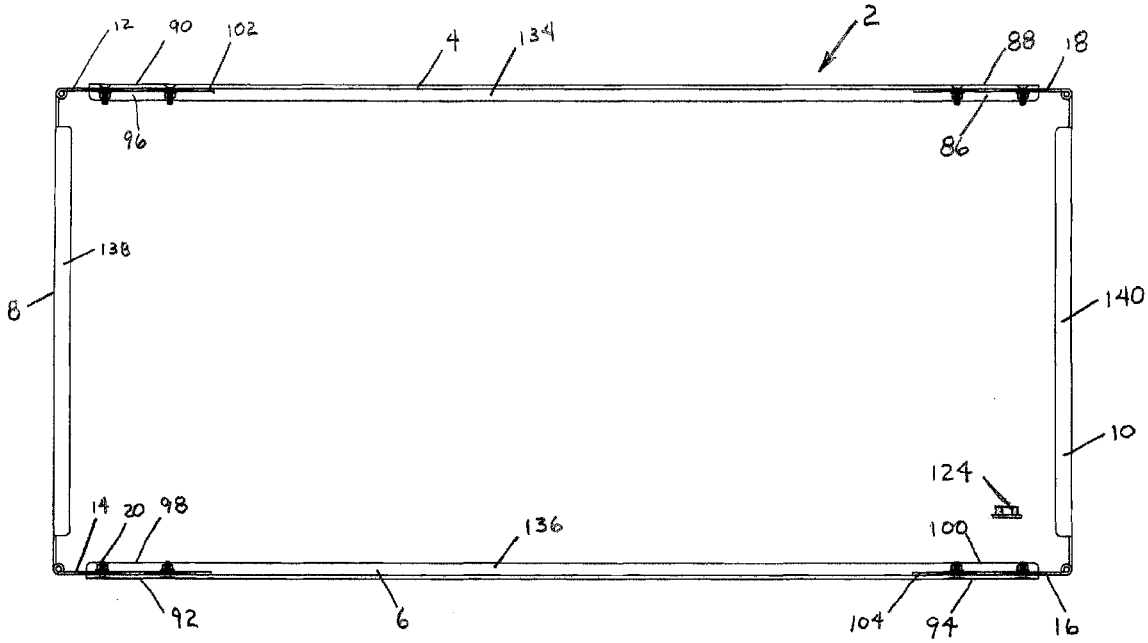
FIG. 1 is a top view of an assembled system according to an embodiment of the invention.
Figure 3:
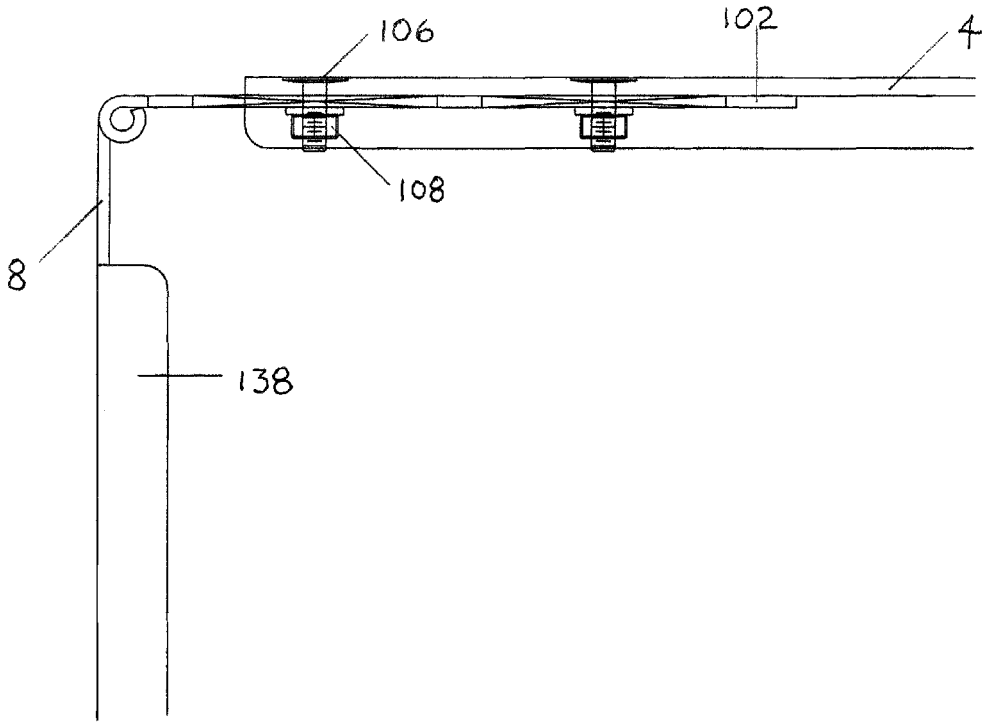
FIG. 3 is a top view of a portion of an assembled system according to an embodiment of the invention.
Figure 4:
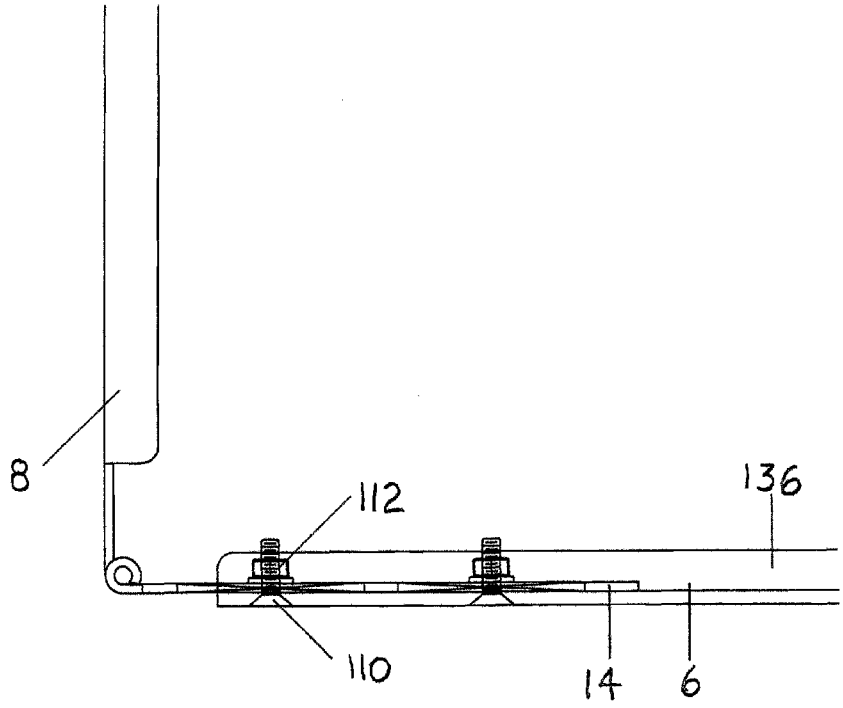
FIG. 4 is a top view of a portion of an assembled system according to an embodiment of the invention.
Figure 5:
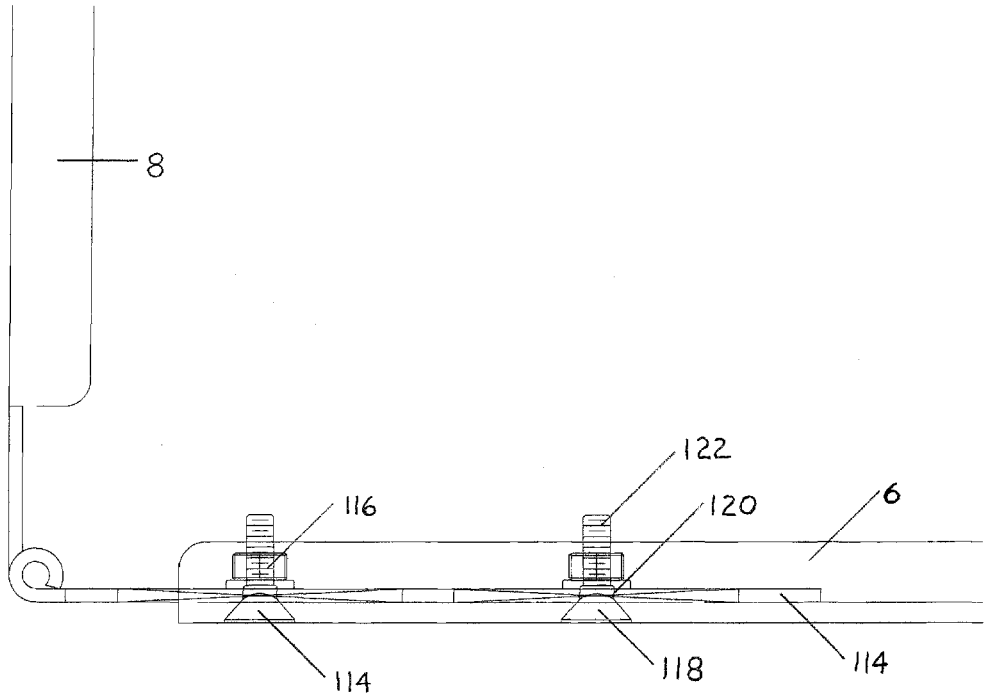
FIG. 5 is a top view of a portion of an assembled system according to an embodiment of the invention.

For simplicity and clarity of illustration, the figures illustrate the general manner of construction; descriptions and details of well-known features and techniques may be omitted to avoid unnecessarily obscuring the invention. Additionally, elements in the figures are not necessarily drawn to scale. The same reference numerals in different figures denote the same elements.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The term "attached," as used herein, is defined as firmly securing, joining, fixing, fastening, or otherwise connecting one item to another item, in a removable or non-removable manner, either directly or via one or more intermediate items secured to the items described as "attached" to one another in a manner appropriate for the specific items.

DETAILED DESCRIPTION OF THE INVENTION

Embodiments of the invention generally provide adjustable systems and/or methods for mounting and/or otherwise securing countertops, vanity tops, bar tops, bench seats, table tops, desk tops, and other similar structures (referred to as individually as a "countertop" and collectively as "countertops") to one or more substantially vertical surfaces, such as a wall, a divider, and/or a vertical surface or surfaces that compose a structure comprising a mounted horizontal surface, e.g., vertical sides of a desk, table, or bench (referred to individually as a "wall" and collectively as "walls"). Thus, systems of the invention comprise one or more rails, support members, and/or other supporting structures (individually, a "support member") that, when installed, are secured, connected, and/or otherwise attached to the wall or walls. A countertop can then be placed on the support members (and, if necessary or desirable, secured, connected, and/or otherwise attached to the rails, support structures, and/or supporting members) to create a wall-mounted vanity, countertop, table, desk, bar, bench, or similar structure. As noted above, a wide variety of materials are used and available for use as a countertop and are suitable for use in connection with a system of the invention.

Embodiments of the invention are particularly suited for applications in which the countertop is not primarily supported by a structure in contact with the floor or similar surface, e.g., via a vanity base, cabinet, or other supporting structure in contact with the floor. However, systems of the inventions may be advantageously used in applications in which some such support structures are provided, e.g., a console-style vanity, a table or desk mounted on a wall at one end and supported by legs or other structures at the other end.

FIG. 1 illustrates an assembled system 2 according to an embodiment of the invention. In this embodiment, the system comprises a plurality of support members; specifically, a back member 4, a front member 6, a first side member 8, a second side member 10, a plurality of adjustment members 12, 14, 16, 18, and a plurality of fasteners 20. Component parts of the system of FIG. 1 are illustrated on FIGS. 2A-2H. FIGS. 2A and 2B illustrate the top and front of a first adjustment member; FIGS. 2E and 2F illustrate the top and front of a second adjustment member. FIGS. 2G and 2H illustrate, respectively, a front member and back member of a system according to an embodiment of the invention.

"Support member" as used herein shall be broadly understood to refer to and include a back member, a front member, a side member, and/or other support members (as described below). At least one support member will be capable of attachment to a wall—that support member is typically referred to as the "back member." Accordingly, a back member 4 comprises one or more mounting points at which it (and, by extension, a system comprising a back member) can be, will be, and/or is attached to a wall.

Methods of securing a structure to a wall are well-known and need not be described in detail. For example, it is known to preferably include blocking 300 in the wall to receive anchoring devices, such as bolts, screws, and/or nails. A mounting point may comprise a hole or other aperture adapted to receive the shaft of a bolt, screw, nail, or other suitable anchoring device. Preferably mounting points are pre-drilled and/or otherwise provided as a component of a back member when a system is provided for assembly and/or attachment to a wall. However, mounting points can be drilled or otherwise created on-site, in which case "mounting point" may simply refer to the point at which a back member is attached to a wall via an anchoring device. Epoxy and/or other adhesives may be used as an anchoring device, in which case "mounting point" may refer to the point of application of such adhesive. As will be understood by those with skill in the art, the number of preferred mounting points will be determined, at least in part, by the weight and/or dimensions of the countertop that will be mounted using a system of the invention.

A "side member" will be capable of attachment to a back member, either directly or via one or more intervening structures, such as an adjustment member. Optionally, a side member will be capable of attachment to a front member and/or a wall. A side member capable of attachment to a wall will comprise one or more "mounting points" and may be mounted to a wall, as described above in reference to a back member.

"Front member" refers to a support member that supports a countertop at or near its front edge. It may comprise one or more points at which a vertical apron 170, modesty panel, shelf, drawer base, or other component may be attached. Although the illustrated flat front members, when included as a component of a system of the invention, are substantially parallel to a back member, other configurations may be used. For example, a front member that is curved along all or a portion of its length may be preferred for certain countertops supported by a system of the invention. By way of further example, a system of the present invention can be used to support a wedge-shaped countertop, e.g., one that is triangular or one that has a first side that is longer than a second side. If triangular, then a front member may intersect, touch, and/or attach to a back member at one end of an assembled system of the invention.

A front member is not a necessary component of a system of the invention. Furthermore, if provided, a front member need not span all or substantially all of the length of the countertop.

In another embodiment (not shown), a front member may comprise a box beam and/or welded tubing. Such an embodiment preferably comprises an open end to receive a portion of an adjustment member and/or an access hole or other aperture to accommodate a fastening device and/or access to a fastening device.

A support member of a system of the invention preferably comprises a support flange 134, 136, 138, 140 along all or part of the top edge of the support member the invention that can support a countertop. When a system of the invention is used to support a countertop, the countertop 142 can rest on and/or be attached to the support flanges. Although the illustrated embodiments of support members comprise support flanges that extend horizontally from the vertical plane of the support member, in other embodiments the support member may be sufficiently thick to support a countertop on its top edge without an additional horizontal extension. In such embodiments, "support flange" would refer simply to all or a portion of the top edge of a support member. For example, in an embodiment in which a support member comprises a box beam, the top of the support member may compose the support flange for such support member.

As will be understood by those with skill in the art, the desired dimensions of a support flange may vary depending upon the material comprising the support member, the material comprising the countertop, and/or the dimensions of the countertop; in some embodiments, a support flange will preferably comprise a "width" (i.e., a horizontal surface on which a countertop may rest) of between approximately 0.5 inches and approximately 1 inch; particularly preferred is a width of at least 0.75 inches.

A front member and/or back member of a system of the invention may optionally comprise a lower flange 144, 146 that comprises a horizontal extension along all or part of its lower edge. A lower flange may serve as an attachment point for, e.g., shelves, drawers, and/or other features that may desirably be included with a vanity, table, desk, bar, bench, and/or other structure comprising a countertop supported by a system of the invention. Providing the optional lower flange provides a further advantage in that a front member and back member can then be interchangeable, i.e., a "back member" turned upside down, may be used as a front member. A side member may comprise a lower flange and, in such an embodiment, a left side member and a right side member may be similarly interchangeable. Although optional, these and other features that allow interchangeability of component parts of a system of the invention may provide further benefits and/or improvements over prior art mounting systems, such as ease of manufacturing, reduced manufacturing costs, reduced waste, and/or reduced inventory costs.

Furthermore, the interchangeability of component parts of a system of the invention may promote creativity in design of countertops (and resultant structures) mounted using a system of the invention. In addition to the adjustability of systems of the invention provided by hinge adjustment features and/or length adjustment features, as discussed below, adjustability may be provided by offering a plurality of lengths of support members. By incorporating, a variety of interchangeable sizes, hinge adjustment features, and/or length adjustment features, systems of the invention can be used to mount unusually-shaped countertops with the same or nearly the same ease as a traditional rectangular countertop.

Although the illustrated embodiments comprise a back member, a front member, and two side members positioned at or near the edges of the supported countertop, not all of these support members are necessary for all embodiments of a system of the invention. In addition, a countertop set upon and/or otherwise attached to a system of the invention may overhang one or more support members, particularly a support member not attached to a wall. Thus, "side" member may refer to a support member displaced some distance from the side (or edge) of a countertop. Similarly, the front edge of a countertop may extend some distance beyond a "front" support member. Furthermore, while a system of the invention preferably comprises at least one side member, a side member is optional; as will be apparent from the discussion that follows, an embodiment of a system of the invention comprising no side member would comprise at least one length adjustment feature but would not comprise a hinge adjustment feature.

Preferably, a support member of a system of this invention is comprised of aluminum alloy, such as 6061 aluminum alloy, 5052 aluminum alloy, 3171 aluminum alloy, and/or other aluminum alloys with characteristics suitable for use in a system of the invention. Aluminum is preferred, in part, due to its relative strength per unit of weight, making systems of the invention that comprise aluminum lighter, easier to handle, and cheaper and easier to ship that systems comprising other materials. Additionally, as a highly recycled and recyclable material, aluminum is typically view as an environmentally sensitive material choice. Other metals and/or materials may be used to compose a support member of the present invention, such as fiberglass, steel, super tough polyamide 6,6 (more commonly known as super tough nylon) resin, polypropylene, polyethylene, carbon fiber, and/or engineered wood. The same and/or similar materials are presently preferred for attachment members of a system of the invention. Preferably, support members and attachment members of a system of this invention are manufactured using standard fabricating techniques known in the art. Other manufacturing techniques known in the art may also be used.

In certain embodiments, as discussed herein in detail, a component of this invention may include one or more elements formed as an integral part of the component. Preferably, such integral elements are made with the same material as other portions of the component, e.g., aluminum alloy, and are formed during the fabricating (or other manufacturing) process otherwise used to create the component. However, other embodiments may include elements of a component that are attached, secured, and/or otherwise integrated in a separate process and/or that comprise a material that differs in some respects from the material or materials comprising other elements of the component and/or system. For example, a side member of a system of the invention may comprise wood and/or steel while an adjustment member of that same system comprises aluminum.

As noted above, adjustability of systems of the present invention is provided, at least in part, by (1) a hinge adjustment feature and/or (2) a length adjustment feature.

A hinge adjustment feature allows a system of the invention to accommodate a variety of angles between a first supporting wall and a second supporting wall. For example, a typical angle of intersection of a first and second wall, as illustrated on architectural plans, is ninety degrees. However, as built, the angle of intersection may be something other than ninety degrees, e.g., it may be "out of square." In addition, in other applications, the angle of intersection of a first and second wall may be intentionally obtuse or acute.

A hinge adjustment feature of the invention allows an installer (or other user of a system of the invention) to match (or substantially match) the angle between a first and second support member with the angle of intersection of a first and second wall. Accordingly, systems of the invention advantageously eliminate the need to create, fabricate, build, and/or otherwise provide a mounting system specific to a particular wall angle. Instead, systems of the invention can be provided and easily adjusted on-site to a wide variety of wall angles. Thus, systems of the invention may, inter alia, (1) reduce the time required to install a mounting system, (2) reduce the costs of installing wall-mounted countertops, (3) reduce material waste, and/or (4) provide greater flexibility in design of wall-mounted countertops since a system of the invention can be mounted to walls intersecting an acute or obtuse angles just as easily as to walls intersecting at a right (or nearly right) angle.

A hinge adjustment feature provides a pivotal connection between a first and second support member. In the embodiment of the invention illustrated on FIGS. 1-2H, a hinge adjustment feature comprises a first hinge portion 22 of a first support member (in this embodiment, a side member 8) and a hinge portion 24 of a first adjustment member 18, which first adjustment member is attached to a second support member (e.g., a back member 4). Optionally, and as illustrated in these figures, a system of the invention may further comprise a second hinge portion 26 of a support member (e.g., a side member 8) and a hinge portion 28 of a second adjustment member 14.

Figure 7A:
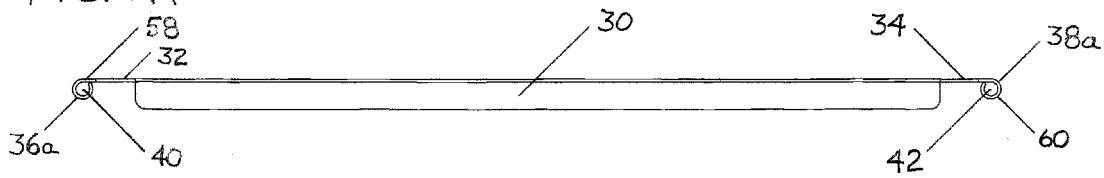
FIG. 7A is a top view of a side member of a system according to an embodiment of the invention.
Figure 7B:
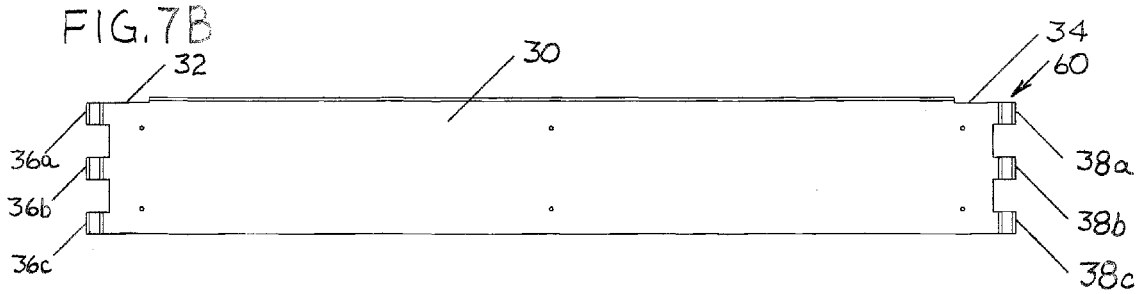
FIG. 7B is a front view of a side member of a system according to an embodiment of the invention.
Figure 8A:
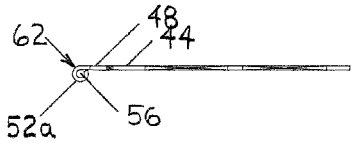
FIG. 8A is a top view of an adjustment member of a system according to an embodiment of the invention.
Figure 8B:
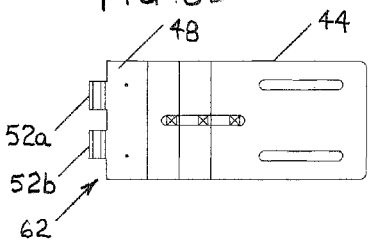
FIGS. 8B and 8C are front views of adjustment members of a system according to an embodiment of the invention.
Figure 8C:
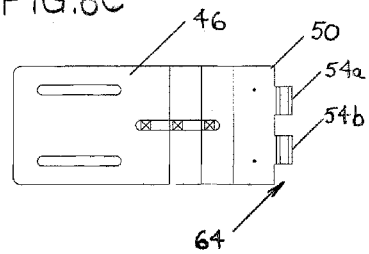

FIG. 7B is a close-up view of the front of a side member 30 and FIGS. 8B and 8C are close-up views of a first and second adjustment member 44, 46, each according to an embodiment of a system of the invention. In this embodiment, the side member 30 comprises a hinge portion 58, 60 on each of a first end 32 and second end 34 of the side member 30. Additionally, each adjustment member 44, 46 comprises a hinge portion 62, 64 on a first end 48, 50 of the adjustment member 44, 46.

In the illustrated embodiment, each hinge portion 58, 60 of the side member 30 comprises three knuckles 36*a*, 36*b*, 36*c*, and 38*a*, 38*b*, 38*c*, spaced to mate with two knuckles 52*a*, 52*b* and 54*a*, 54*b* that compose hinge portions 62, 64 of the first and second adjustment members 44, 46. In this embodiment, upon assembly, knuckles 54*a*, 54*b* of adjustment member 46 would preferably mate with knuckles 36*a*, 36*b*, 36*c* of the hinge portion 58 of the first end 32 of the side member 30. Optionally, the mated knuckles could be secured with a pin (not shown) or similar device.

Figure 9:
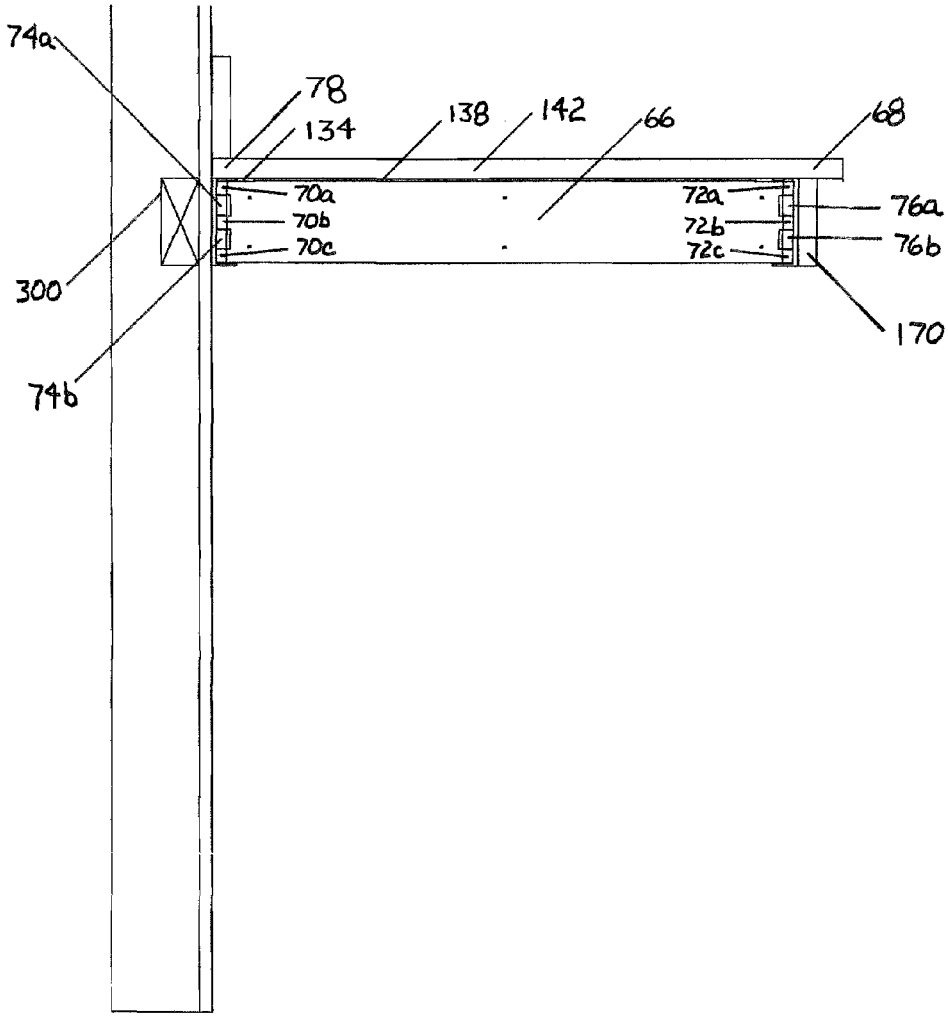
FIG. 9 is a side view of a portion of an assembled system according to an embodiment of the invention.

The cross-sectional illustration of FIG. 9 illustrates a portion of an assembled system according to an embodiment of the invention in which knuckles 70*a*, 70*b*, 70*c* of a first hinge portion and knuckles 72*a*, 72*b*, 72*c* of a second hinge portion of a side member 66 are mated, respectively, with knuckles 74*a*, 74*b* of a hinge portion of a first adjustment member and knuckles 76*a*, 76*b* of a hinge portion of a second adjustment member to create a first and second hinge adjustment feature 78, 68 of a system according to an embodiment of the invention.

In one embodiment, adjustment members are interchangeable, e.g., a particular adjustment member would mate at a hinge adjustment portion with a first side member at a first orientation and would also mate with a second side member at a second orientation—specifically, when rotated 180 degrees from the first orientation. By providing adjustment members that are not specific to a certain side, benefits of systems of the invention—including ease of use, diminished material costs, adaptability, and the like—may be further enhanced.

Although the illustrated embodiment comprises a hinge adjustment feature in which three knuckle of a side member mate with two knuckles of an adjustment member, other knuckle configurations and/or hinge types may be used in a hinge adjustment feature of a system of the invention. For example, a single knuckle of a side member could be adapted to mate with two knuckles of an adjustment member. By way of further example, a hinge adjustment feature may comprise a bearing or barrel on an end of a support member adapted to received a pin composing an adjustment member (or vice versa), or a hinge adjustment feature comprising polypropylene or polyethylene may allow pivot or pivot-like movement by virtue of flexibility of the material. Thus, hinge adjustment member should be broadly understood and shall refer to and include a mechanism and/or system that allows pivoting and/or pivot-like movement at the intersection of a support member and an adjustment member.

As noted, a hinge adjustment feature provides a pivotal connection between a first a second side member. A hinge adjustment feature could be provided, e.g., by providing a hinge portion of a first end of a side member and a hinge portion of a first end of a back member, wherein such hinge portions comprise knuckles and/or pins adapted to mate to create a hinge or pivotal connection. As discussed above, in a preferred embodiment of a system of the invention, a hinge adjustment feature comprises an intervening adjustment member, capable of attachment to a second side member, that comprises a hinge portion. In such an embodiment, the adjustment member preferably composes a length adjustment feature in addition to composing a hinge adjustment feature.

A length adjustment feature allows a system of the invention to accommodate a variety of countertop lengths, e.g., between two side walls, between one side wall and another feature, such as cabinetry, and/or to simply accommodate a variety of desired countertop lengths. For example, in a commercial setting, such as a hotel, architectural plans may specify a nominal length of, e.g., 48 inches. However, as built, the space available for a countertop (particularly one that is to fill an alcove) may be something other than 48 inches.

A length adjustment feature of the invention allows an installer (or other user of a system of the invention) to use the same size and type of system for installations of all countertops of a particular specified size because the length adjustment feature will allow for differences between the specified length and actual length on-site. Furthermore, a single system will accommodate a range of lengths, thereby simplifying the process of obtaining and/or stocking supplies for mounting countertops. Accordingly, systems of the invention that incorporate a length adjustment advantageously eliminate the need to create, fabricate, build, and/or otherwise provide a mounting system specific to a particular countertop length. Instead, systems of the invention can be provided and easily adjusted on-site to a wide variety of countertop lengths. Thus, systems of the invention may, inter alia, (1) reduce the time required to install a mounting system, (2) reduce the costs of installing wall-mounted countertops, (3) reduce material waste, and/or (4) reduce inventory and/or supply requirements.

A length adjustment feature permits adjustment in the length of a support member. In the embodiment of the invention illustrated on FIGS. 1-2H, a length adjustment feature 88 comprises a plurality of adjustable connection points 80*a*, 80*b*, 80*c* of an adjustment member 18 in which the adjustment member 18 is adapted to be connected to, e.g., a back member 4 at a plurality of connection points 84*a*, 84*b*, 84*c* on a first end 86 of the back member 4 via a plurality of fasteners 20. Optionally, and as illustrated in these figures, a system of the invention may further comprise length adjustment features

90, 92, 94 that comprise connection points at a second end of a back member 96, a first end of a front member 98, and/or a second end of a front member 100. In each case, the plurality of connection points are preferable adapted to be connected to an adjustment member via a plurality of adjustable connection points.

Figure 6:
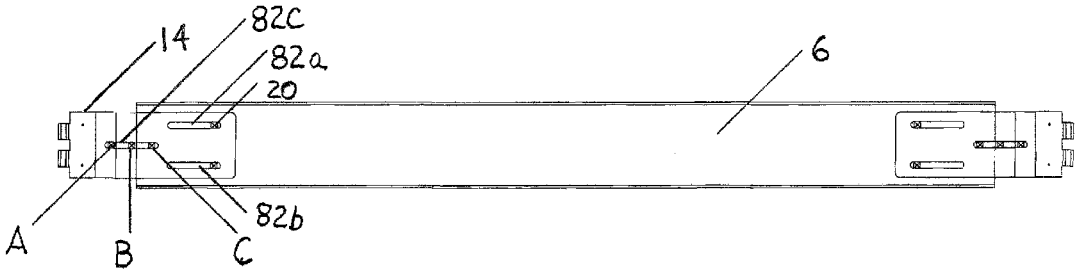
FIG. 6 is a front view of a portion of an assembled system according to an embodiment of the invention.

FIG. 6 illustrates a length adjustment feature according to an embodiment of the invention. A fastener 20 is inserted through a connection point on a front member 6 and through an adjustable connection point of an adjustment member 14. The adjustable connection points 82*a*, 82*b*, 82*c*, of the adjustment member 14 allow the adjustment member to move along the front member 6 to a desired span, at which point the fastener can be secured to firmly attach the front member to the adjustment member and to prevent or minimize further movement between the front member and the adjustment member.

An adjustable connection point preferably comprises a slot, rail, or other feature that allows horizontal movement of an adjustment member along a support member (e.g., a back member and/or front member) and at which an adjustment member and support member can be securely attached at a desired length or span. An adjustable connection point will preferably allow length adjustments in the range of approximately 1.5 inches to approximately 3.5 inches; particularly preferred is an adjustable connection point that allows length adjustments of approximately two inches. If two such adjustment members are used, e.g., in connection with a back member, a single system of the invention could accommodate span length distances of approximately four inches. Adjustment members that allow for greater variety of span lengths may be preferred and/or used in other embodiments.

"Fastener" should be broadly understood and refers to a mechanism, material, structure, or other fastening device used to attach components of a system of the invention, such as a hinge portion to a back member, side member, and/or front member. A fastener of this invention is preferably of sufficient strength to withstand the forces imposed on it as a component of a system of this invention.

Figure 10:
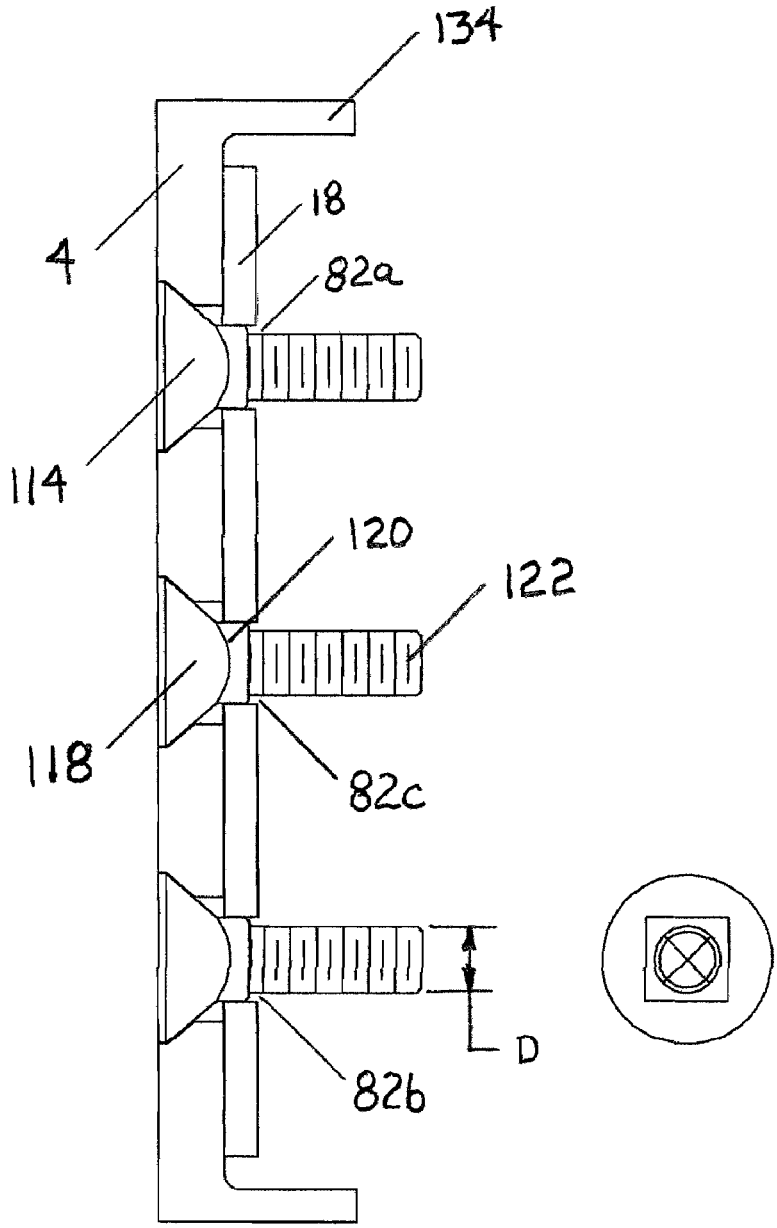
FIG. 10 is a side view of a cross section of a back member of a system according to an embodiment of the invention.

Suitable fasteners for use in this invention may include screws, bolts and nuts, locking pins, rivets, and other similar mechanical fastening devices known in the art. Preferred fasteners include, for example, elevator bolts 106 and nuts 108, countersunk machine screws 110 and nuts 112, plow bolts 114 and nuts 116, and sex bolts. More generally and, in particular, for length adjustment features comprising a portion of a back member, a preferred fastener is one capable of being secured to attach, e.g., a back member to an adjustment member without access to the head of the fastener; specifically, "blind fasteners", as such term is known in the art, are preferred. For example, as illustrated on FIG. 10, a typical plow bolt 114 comprises a circular head 118, a square shank 120, and a shaft 122. An adjustable connection point 82*a*, 82*b*, 82*c* may then comprise a height D that is approximately equal to and slightly greater than the length of a side of the square shank 120. Then, when a nut 124 is attached to the shank 122 of the plow bolt 114, the adjustable connection point 82*a*, 82*b*, 82*c* will engage the shank 120 of the plow bolt 114, preventing or minimizing rotational movement of the plow bolt 114 within the adjustable connection point, allowing a secure attachment of the back member to the adjustment member.

A fastener may be an integral fastener, in which it is formed as a part of a support member, e.g., a back member or a front member. For example, a back member may comprise a pin or other protrusion adapted to be received by one or more adjustable connection points of an adjustment member, which pin or other protrusion can be soldered, riveted, other otherwise used to secure the back member to the adjustment member or which pin or other protrusion is adapted to receive a nut, locking clip, or the like to secure the back member to the adjustment member. In such an embodiment, "fastener" may refer to the integral fastener or the integral fastener and nut, locking clip, or the like, as appropriate given the particular embodiment of a system of the invention.

Although the adjustable connection points are illustrated as slots, other forms of adjustable connection points may be used. For example, a groove could be provided on the adjustment member adapted to mate with a rail on the back member (or vice versa), such that the adjustment member could slide along some portion of the back member to the desired span. At the desired span, the adjustment member and back member could be firmly attached by applying a clip, a stop (e.g., a barrier in the groove and/or on the rail), and/or via another mechanical feature. Alternatively or additionally, further movement could be prevented by applying an adhesive, such as an epoxy, to the adjustment member and/or back member.

Metals, such as aluminum, steel, and/or zinc are preferred materials for fasteners of this invention. However, other materials that provide sufficient yield points and tensile strength (given the demands of a particular application of a system of this invention) may be used.

Although the adjustable connection points on the illustrated embodiments are located on the adjustment members, other embodiments of systems of the invention may comprise adjustable connection points on a back member and/or front member. Furthermore, although the illustrated embodiments comprise adjustable connection points for each end of a system, adjustable connection points may be provided at just one end of a system.

Although it is presently preferred that a mounting point be separate from a connection point, in other embodiments of a system of the invention, a connection point and a mounting point may be the same. In such an embodiment, the connection point of the back member may be adapted to receive the shaft of a mounting device and corresponding adjustable connection point may comprise a first end adapted to receive the head of the mounting device (such that the adjustment member can be placed over the mounting device after it has been used to secure the back member to a wall) and a second end with a height approximately equal to and slightly larger than the diameter of the shaft of the mounting device, such that the adjustment member can slide along the back member to the desired span. When the desired span is reached, the mounting device can be fully secured to securely attach the back member of the system to the wall and to securely attach the adjustment member to the back member.

In a preferred embodiment of a system of the invention, as illustrated in the accompanying figures, and as discussed above, a single adjustment member composes elements of each of a hinge adjustment feature and a length adjustment feature. By incorporating elements of both adjustment features with a single component, systems of the invention that use such an adjustment member benefit from the manufacturing, use, and installation flexibility of such a design. In such an embodiment, selection of an adjustment member (or a pair of adjustment members) can be independent of selection of length and/or other configuration of other support members of a system of the invention.

Figure 11:
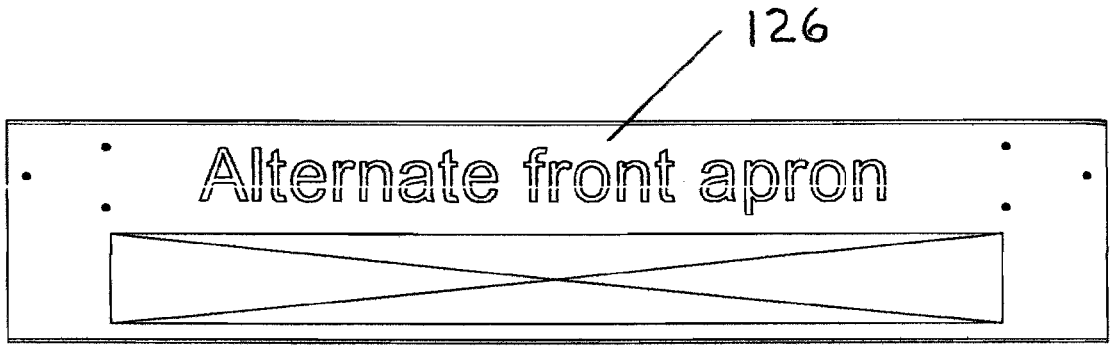
FIG. 11 is a front view of a front member of a system according to an embodiment of the invention.

FIG. 11 illustrates an alternative embodiment of a front member 126 according to a system of the invention in which a opening is provided that can be used to receive an electrical outlet box, a tissue dispenser, a trash can receptacle, a toilet paper dispenser, and/or other features that may be necessary or desirable depending on the particular application for which a system of the invention will be used.

Figure 12:
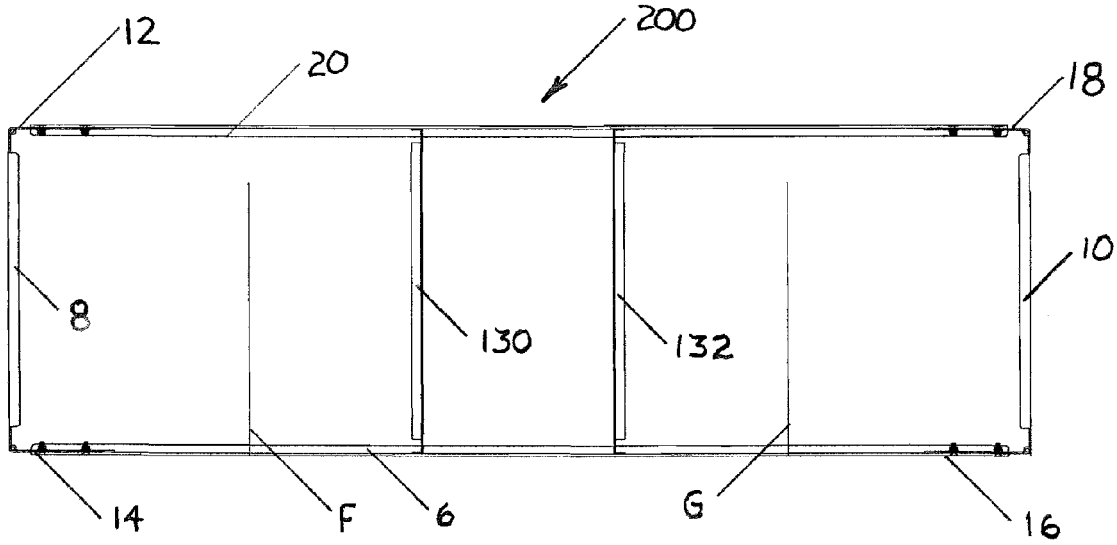
FIG. 12 is a top view of an assembled system according to an embodiment of the invention.
Figure 16:
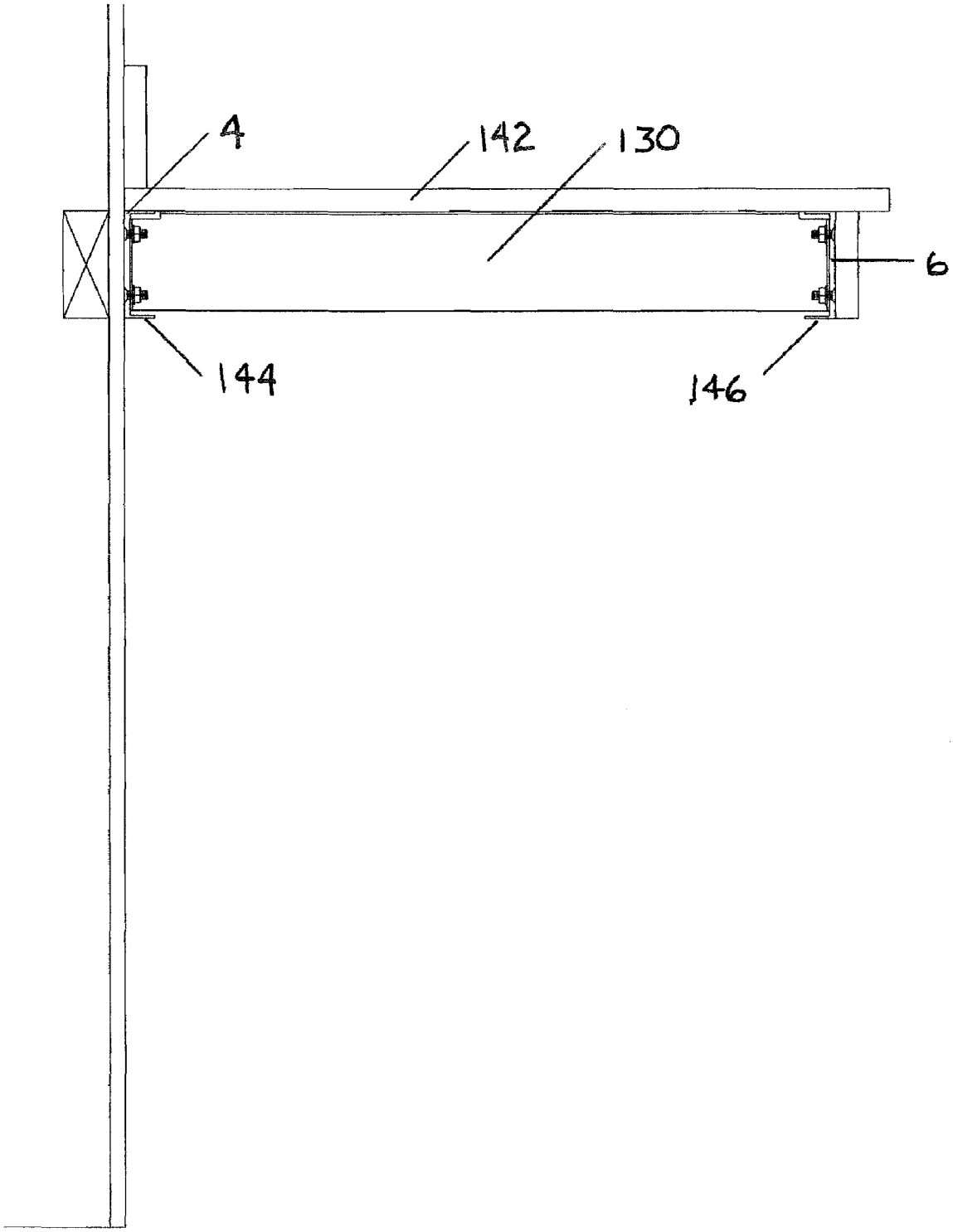
FIG. 16 is a cross-sectional side view of a portion of an assembled system according to an embodiment of the invention.

The embodiment of a system 200 of the invention of FIG. 12 illustrates optional intermediate support members 130, 132 which can be incorporated into a system of the invention to provide additional support if, e.g., necessary or desirable given the length or width of a countertop. Lines F, G illustrate possible centerlines for sinks if, for example, a system of the invention would be used to support a wall-mounted vanity. As with other support members, and as illustrated on FIG. 13A, an intermediate support member 130 also preferably comprises a support flange 141. An intermediate support member will be adapted to be attached to a back member at attachment points 131, 133 and, preferably, a front member if the intermediate support member provides additional support along the length of a countertop. An intermediate support member that provides additional support along the width of a countertop will be preferably adapted to be connected to a side member or side members comprising a system of the invention; such an intermediate support member may be used in lieu of a front member—in other words, a front member need not be placed at or near the front of the countertop if the system is otherwise capable of supporting the countertop.

FIG. 14-15C illustrate an alternative embodiment of a support member 160 of a system of the invention. This support member 160 comprises a wedge-shaped portion 164 disposed from the lower edge of the support member 160. The wedge-shaped portion preferably comprises an attachment flange 168 adapted to receive, e.g., a modesty panel for a vanity mounted to a wall using a system of the invention. Additionally, the support member 160 is preferably adapted to be connected to a back member and/or front member, e.g., via an upper attachment flange 170. An aperture 166 is recommended if the back member comprises a lower flange. Furthermore, mounting points 172, 174, 178, 180 may be provided on a mounting flange 176, 182 of a support member 160. A support member 160 may be used as an intermediate support member, e.g., placed between two side members. Alternatively, a support member 160 may be used as a side member. A support member 160 is particularly useful as a side member in applications in which one or both sides of the wall-mounted countertop will not be mounted to a wall, e.g., in which one or both ends are "floating" or "open-ended."

In one embodiment, a system of the invention is assembled according to a method comprising the following steps: (1) providing a system comprising a back member, a first side member, a first adjustment member, a plurality of fasteners, and a plurality of anchoring devices, (2) inserting a bolt (or other component of a fastener) through a connection point of the back member and through an adjustable connection point of the first adjustment member; (2) loosely attaching a nut (or other component of a fastener) to the bolt, (3) attaching the back member to the wall via one or more anchoring devices, (4) sliding the first adjustment member along the back member to the desired span, (5) tightening the nut to secure the back member to the first adjustment member, (6) mating the hinge portion of the first, adjustment member with the hinge portion of the first side member, and (7) mounting the first side member is attached to a wall. Steps may be performed in other orders; for example, if the desired span is known, the back member could be securely attached to the adjustment member to achieve the desired span before the back member is attached to the wall. Similarly, the hinge portions of the side member and adjustment member may be mated before or after the adjustment member has been positioned to achieve the desired span and/or before or after the back member has been attached to the wall.

If a system further comprises a second side member, a front member, one or more additional adjustment members, and/or one or more intermediate support members, such components can be similarly attached to the other components of the system and/or a wall in a manner similar to that described above.

The term "providing a system comprising a back member, a first side member, a first adjustment member, a plurality of fasteners, and a plurality of anchoring devices" and the like should be broadly understood and include and/or refer to situations where a party assembling a system of this invention has e.g., received, obtained, or is otherwise providing all such components of a system and/or in which a third party has received, obtained, or otherwise provided to the party assembling (or partially assembling) such components of a system to the party assembling a system of this invention.

Furthermore, the terms "inserting," "loosely attaching," "attaching," "sliding," "tightening," "mating," "mounting" and the like should be broadly understood and include and/or refer to any situations, steps, and/or other circumstances resulting in attachment of the component parts of a system to one another and mounting the system, via one or more of its component parts, to one or more wall. Furthermore, such term broadly understood and include and refer to, e.g., situations where a party assembling a system of this invention has performed all of the steps that result in such attachment and mounting, as well as to situations where a third party has performed one or more of the steps that result in such attachment and mounting.

As will be understood by those with skill in the art, the steps used to assemble and/or mount a system of the invention may vary depending upon the components comprising a particular embodiment. As noted above, system may be provided "on-site" completely disassembled, partially assembled, or fully assembled.

As noted above, terms of orientation are provided for descriptive purposes. For example, although systems of the invention described and illustrated herein are shown and described to accommodate a horizontal (or substantially horizontal) countertop, systems of the invention may also be advantageously employed to mount a vertical "countertop," e.g., to mount wood, stone, metal, glass, solid surface, etc. to create a room divider or other vertically mounted feature. In such an embodiment, the "support flange" of a support member may serve as an "attachment flange" to accommodate attachment of the vertical "countertop" to one or more support members of a system of the invention; the attachment flange may comprise one or more attachment points adapted to accommodate such an attachment. Similarly, a "length" adjustment feature may serve to accommodate differences in height.

Although certain illustrative embodiments have been disclosed, it will be apparent from the foregoing disclosure to those skilled in the art that variations and modifications of such embodiments may be made without departing from the spirit and scope of the invention. Accordingly, it is intended that the invention should be limited only to extent required by the appended claims and the rules and principals of applicable law.

I claim:

1. A wall-mounted structure comprising:

(a) a countertop;

(b) a first support member comprising a first connection point on a first end and a second connection point on a second end;

(c) a second support member comprising a first hinge portion on a first end;

(d) a first adjustment member comprising an adjustable connection point and a hinge portion, wherein (i) the hinge portion of the first adjustment member is adapted to be mated with the first hinge portion of the second support member and (ii) the first adjustment member is adapted to be attached to the first support member at the first adjustment member adjustable connection point and at the first connection point of the first support member;

(e) a third support member comprising a first hinge portion on a first end;

(f) a second adjustment member comprising an adjustable connection point and a hinge portion, wherein (i) the hinge portion of the second adjustment member is adapted to be mated with the first hinge portion of the third support member and (ii) the second adjustment member is adapted to be attached to the first support member at the first adjustment member adjustable connection point and at the second connection point of the first support member;

(g) a fourth support member comprising a first connection point on a first end and a second connection point on a second end;

(h) a third adjustment member comprising an adjustable connection point and a hinge portion, wherein (i) the hinge portion of the third adjustment member is adapted to be mated with a second hinge portion on a second end of the second support member and (ii) the third adjustment member is adapted to be attached to the fourth support member at the third adjustment member adjustable connection point and at the first connection point of the fourth support member; and (i) a fourth adjustment member comprising an adjustable connection point and a hinge portion, wherein (i) the hinge portion of the second adjustment member is adapted to be mated with a second hinge portion on a second end of the third support member and (ii) the fourth adjustment member is adapted to be attached to the fourth support member at the fourth adjustment member adjustable connection point and at the second connection point of the fourth support member.

2. The structure of claim 1 wherein the first adjustment member is functionally interchangeable with the second adjustment member.

3. The structure of claim 2 wherein the second support member is functionally interchangeable with the third support member.

4. The structure of claim 1 wherein the first support member is functionally interchangeable with the fourth support member.

5. The structure of claim 1 wherein each support member further comprises a support flange.

6. The structure of claim 1 further comprising a plurality of blind fasteners adapted to be received by the connection points of the first support member and the adjustable connection points of the adjustment members.

7. The mounting system of claim 1 wherein each adjustable connection point allows length adjustments in the range of approximately 1.5 inches to approximately 3.5 inches.

8. A countertop mounting system comprising:

(a) a plurality of at least three support members, wherein each support member comprises at least one of a hinge portion and a connection point, and wherein the plurality of at least three support members comprises at least three hinge portions and at least three connection points; and (b) a plurality of at least three adjustment members, wherein each adjustment member comprises a hinge portion and a connection point, and wherein each of the adjustment members is adapted to be attached to the connection point of one of the support members comprising a connection point and to mate with the hinge portion of another one of the support members comprising a hinge portion.

9. The mounting system of claim 8, wherein each support member further comprises a support flange.

10. The mounting system of claim 8 further comprising a blind fastener adapted to be received by the connection point of at least one of the support members and by the connection point of at least one of the adjustment members.

11. The mounting system of claim 8 further comprising an intermediate support member.

12. The system of claim 8 wherein the connection point of at least one of the support members is an adjustable connection point.

13. The mounting system of claim 12 wherein the adjustable connection point allows length adjustments in the range of approximately 1.5 inches to approximately 3.5 inches.

14. A method of installing a countertop mounting system on a wall comprising:

(a) providing a plurality of at least three support members, wherein each support member comprises at least one of a hinge portion and a connection point, and wherein the plurality of at least three support members comprises at least three hinge portions and at least three connection points; and (b) providing a plurality of at least three adjustment members, wherein each adjustment member comprises a hinge portion and a connection point, and wherein each of the adjustment members is adapted to be attached to the connection point of one of the support members comprising a connection point and to mate with the hinge portion of another one of the support members comprising a hinge portion;

(c) providing a plurality of fasteners and a plurality of anchoring devices;

(d) attaching a first one of the adjustment members to one of the support members at a connection point with a fastener and mating the first adjustment member to another one of the support members at a hinge point;

(e) attaching a second one of the adjustment members to one of the support members at a connection point with a fastener and mating the second adjustment member to another one of the support members at a hinge portion;

(f) attaching a third one of the adjustment members to one of the support members at a connection point with a fastener and mating the third adjustment member to another one of the support members at a hinge portion; and (g) attaching at least one of the support members to a wall with at least one of the anchoring devices.

15. The method of claim 14 further comprising:

(h) providing a countertop; and (i) placing the countertop on a support flange of each of the support members.

* * * * *